US010507974B2

(12) United States Patent
Pelt

(10) Patent No.: US 10,507,974 B2
(45) Date of Patent: Dec. 17, 2019

(54) PORTABLE MANWAY SECURING APPARATUS

(71) Applicant: Jeffrey Darrel Pelt, Kountze, TX (US)

(72) Inventor: Jeffrey Darrel Pelt, Kountze, TX (US)

( * ) Notice: Subject to any disclaimer, the term of this patent is extended or adjusted under 35 U.S.C. 154(b) by 168 days.

(21) Appl. No.: 15/432,191

(22) Filed: Feb. 14, 2017

(65) Prior Publication Data

US 2017/0267448 A1 Sep. 21, 2017

Related U.S. Application Data

(60) Provisional application No. 62/310,850, filed on Mar. 21, 2016.

(51) Int. Cl.
*B65D 90/10* (2006.01)
*E02D 29/14* (2006.01)

(52) U.S. Cl.
CPC ..... *B65D 90/10* (2013.01); *E02D 29/1427* (2013.01)

(58) Field of Classification Search
CPC ..... B65D 90/00; B65D 90/10; B65D 90/105; B65D 88/76; B65D 90/22; B61D 5/08; B61D 17/16; E02D 29/1427; E02D 29/14
See application file for complete search history.

(56) References Cited

U.S. PATENT DOCUMENTS 2,647,641 A 8/1953 Tritt
4,685,585 A * 8/1987 Robbins ..... B65D 90/105 220/256.1
5,694,859 A * 12/1997 Burke ..... B61D 3/18 105/355
6,095,365 A * 8/2000 Yielding ..... B65D 90/10 105/377.07
D572,982 S 7/2008 de Bretton Gordon
8,038,031 B2 10/2011 DePietro et al.
8,523,126 B2 9/2013 Garrels et al.
9,492,693 B2 * 11/2016 Byrd ..... A62B 35/0068
2006/0219649 A1 * 10/2006 Wolfford, Sr. ..... B66C 23/208 212/166
2007/0235463 A1 * 10/2007 Wyler ..... B60P 3/226 220/835
2013/0270409 A1 10/2013 Osorio

FOREIGN PATENT DOCUMENTS

KR 10-1191872 * 3/2012
KR 1191872 B1 10/2012

OTHER PUBLICATIONS

KR 10-1191872 (English translation) (Year: 2012).*

* cited by examiner

*Primary Examiner* — Mark T Le
(74) *Attorney, Agent, or Firm* — IP Law Leaders PLLC

(57) ABSTRACT

A portable securing apparatus which is readily secured to a manway of a vessel having a portal intended to enable entry of service personnel into the vessel is described. The securing apparatus affords an improved grip to assist service personnel to enter the vessel. The securing apparatus is for temporary mounting to the manway. The securing apparatus includes a mounting plate mountable to a flange conventionally provided as part of the manway, and a handle for accommodating manual grasp of the securing apparatus.

16 Claims, 2 Drawing Sheets

PORTABLE MANWAY SECURING APPARATUS

REFERENCE TO RELATED APPLICATION

This application claims priority of U.S. Provisional Patent Application Ser. No. 62/310,850, filed Mar. 21, 2016, which is incorporated by reference in its entirety.

FIELD OF THE DISCLOSURE

The present disclosure relates to securing apparatus, and more particularly to mountable securing devices for vessels.

BACKGROUND

Tanks, reaction chambers, large pipes, and other vessels may have manways to enable service personnel to enter the vessel. Typically, a manway comprises a short stubpipe projecting perpendicularly from a wall of the vessel, having a radiating flange. The flange contains studs or bolt holes for accommodating fasteners enabling secure mounting of a closure over the manway. In ordinary operation, the closure is securely bolted to the flange to contain pressure and contents of the vessel.

From time to time, service personnel must enter the vessel when the latter is empty. This may be done for example, for inspections, repairs, cleaning, unclogging, installation of instrumentation, and for other purposes. It is often difficult for service personnel to enter a manway. For example, the nature of the chemicals used in the manway may make surfaces of the manway slippery, or otherwise hazardous to contact by hand, such as due to potential toxicity of residues of the substances contained in the vessel.

There exists a need to facilitate entry of service personnel into vessels through manways.

SUMMARY

The disclosed concepts address the above stated situation by providing in exemplary embodiments a portable securing apparatus, such as a handhold, which is readily secured to a manway having a portal intended to enable entry of service personnel into a vessel. The securing apparatus may afford an improved grip to assist service personnel and any others to enter the vessel. The securing apparatus may be mounted on a temporary basis to the manway. The securing apparatus may include a mounting plate mountable to a flange customarily provided as part of the manway, and a handle for accommodating manual grasp of the securing apparatus.

These general concepts and additional inventive concepts are implemented via a plurality of exemplary embodiments. In certain embodiments, a securing apparatus for temporary mounting to a flange of a manway includes a portal enabling entry therein by service personnel into a vessel. The securing apparatus may include a mounting plate temporarily mountable to the flange of the manway, and a handle for accommodating manual grasp of the securing apparatus by the service personnel. The flange of the manway may be secured to a closure over the manway by one or more fasteners, and the mounting plate of the securing apparatus may include a mounting structure cooperating with the fasteners. The fasteners may define threaded shafts thereon, and the mounting structure may define at least one orifice dimensioned and configured to pass the threaded shafts therethrough. The orifices may include at least one elongated hole.

The mounting plate may further define a recess projecting therein, the recess being dimensioned and configured to prevent the mounting plate from obstructing the portal when the securing apparatus is installed on to the manway. A cross-section of the portal can be circular in shape, and the recess may be arcuate in shape and reflect a configuration of the portal of the manway. The handle maybe offset from the recess such that the handle avoids obstructing the portal when the securing apparatus is installed on the manway. The handle may include a grab bar respectively coupled to and spaced apart from the mounting plate. Also, two stanchions for supporting the grab bar may be provided, the grab bar being positioned between the two stanchions. Furthermore, the grab bar can be circular in cross-section thereof and the positioning thereof may be affixed along a longitudinal axis between the two stanchions.

In certain embodiments, a vessel is provided, which includes a manway for enabling entry therein, and the vessel includes: an outer wall defining a chamber for enclosing contents of the vessel; the manway may define a portal to the chamber, the portal penetrating the outer wall; the manway may include a closure and one or more elongated fasteners operable to secure the closure over the portal. A removable securing apparatus may be provided, including a mounting structure cooperating with the fasteners, the removable securing apparatus being operable for installation thereof on the manway where the closure is disengaged from the manway, and the securing apparatus may further include a handle affixed to the mounting structure. The fasteners may include a shaft portion, and the removable securing apparatus can define at least one orifice dimensioned and configured for passage through it of the shaft portion. Additionally, the manway may include a flange portion encircling the portal and presenting a flat face facing away from the chamber; the fasteners may be operable to engage the flange when serving to secure the closure over the portal; and the mounting structure may include a mounting plate, a surface of it operable to seat flush against the flat face of the flange when the mounting plate is engaged with the manway. The fasteners may be operable to be reassembled to the flange to mount the mounting plate to the manway when the closure has been disengaged from the manway. The portal can be circular in cross-section, and the mounting plate can define a recess portion projecting into the mounting plate defined by the outer edge of the portal, whereby the portal of the manway remains unobstructed by the mounting plate when the securing apparatus is in a state of engagement on the manway.

In additional embodiments, a method of facilitating entry of service personnel into a vessel through a manway of the vessel is provided, the method including: removing a closure from the manway by removing one or more fasteners coupling the closure to the manway; installing a securing apparatus in place of the closure, where the securing apparatus includes a mounting structure cooperating with the fasteners of the closure; and fastening the securing apparatus to the manway in place of the closure, using the fasteners coupling the closure to the manway. The method may further include stabilizing the securing apparatus on the manway by seating a surface of a mounting plate of the securing apparatus flush against a flange of the manway when the fasteners secure the mounting plate of the securing apparatus to the flange of the manway.

The nature of the disclosed concepts will become readily apparent upon further review of the following specification and drawings.

BRIEF DESCRIPTION OF THE DRAWINGS

Various objects, features, and attendant advantages of the disclosed concepts will become more fully appreciated as the same becomes better understood when considered in conjunction with the accompanying drawings, in which like reference characters designate the same or similar parts throughout the several views, and wherein.

DETAILED DESCRIPTION

Figure 1:
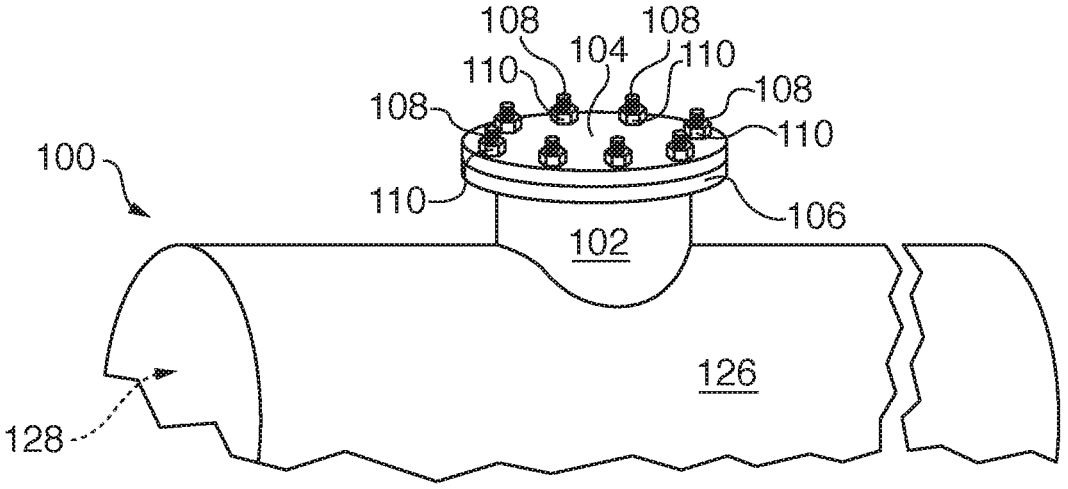
FIG. 1 is a perspective view of the inventive vessel in its ordinary condition, with a manway sealed by a closure in accordance with certain embodiments.

Referring first to FIG. 1, a vessel 100 having a manway 102 to enable entry of service personnel is shown in an exemplary ordinary service condition, with manway 102 sealed by a closure 104. Vessel 100 may contain substances such as, for example, crude petroleum, partially refined petroleum products, fully refined petroleum products, and diverse fluid chemical products. Vessel 100 may also be a pressure vessel intended to contain the substances at pressures elevated from atmospheric pressure, may accommodate chemical reactions, or otherwise support processes using any types of substances.

In certain embodiments, such as in an ordinary service condition, closure 104 is fastened to a flange 106 of manway 102. A gasket (not shown) can also be used to effect leak-tight connection of closure 104 to flange 106. Fasteners, such as threaded fasteners 108, secure closure 104 tightly to flange 106. Fasteners 108 may be threaded bolts 108 or alternatively may include threaded studs (not shown) permanently fixed to flange 106. Either bolts 108 or studs receive nuts 110.

Figure 2:
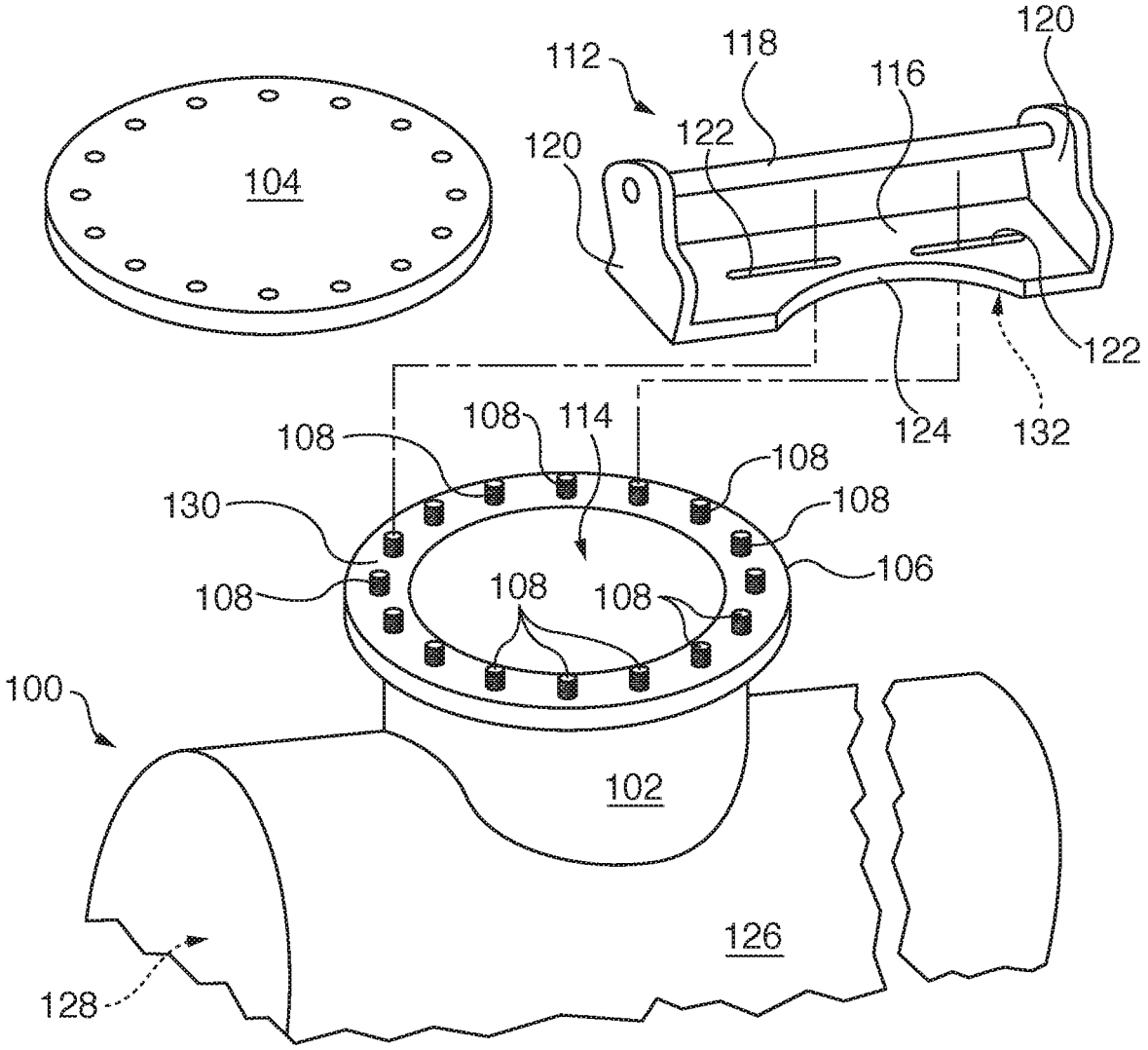
FIG. 2 is an exploded perspective view of the inventive vessel of FIG. 1, also showing an inventive securing apparatus for temporary mounting to the vessel, according to certain embodiments.

FIG. 2 shows closure 104 removed from vessel 100, as would occur, for example, for service operations conducted inside vessel 100. In certain embodiments, a securing device such as securing apparatus 112 is provided for mounting to flange 106 of manway 102 having a portal 114 enables entry of service personnel (not shown) into vessel 100. Securing apparatus 112 provides for temporary or permanent mounting; in the present exemplary embodiment, it provides temporary mounting. In exemplary embodiments, securing apparatus may be held onto in any capacity, by for example, held by an individual's hands or other limbs, secured to the individual with the individual's clothing, or secured by additional apparatus. Securing apparatus 112 in this exemplary embodiment includes a mounting plate 116, mountable for example to flange 106 of manway 102, and a handle for accommodating manual grasp of securing apparatus 112.

In the illustrated exemplary embodiment, securing apparatus 112 includes a grab bar 118 coupled to and spaced apart from mounting plate 116. Grab bar 118 is thereby operable to be readily grasped by service personnel entering vessel 100. Securing apparatus 112 further includes two stanchions 120 for supporting grab bar 118, wherein grab bar 118 is straight between the two stanchions 120. A straight grab bar 118 can be intuitively located for grasping by service personnel who may be visually distracted from concentrating on grab bar 118. In the exemplary embodiment, grab bar 118 is circular in a cross section and passes through a longitudinal axis parallel to the longitudinal axis of securing apparatus 112. In an exemplary embodiment, the circular cross section avoids rough projections and edges to prevent the hands of the service personnel from rotating about grab bar 118, as the service personnel might find convenient when lowering his or her body into vessel 100.

Flange 106 of manway 102 include fastening apparatus, e.g., bolts 108, for securing closure 104 over manway 102. Mounting plate 116 of securing apparatus 112 includes a mounting structure cooperating with the fasteners of flange 106. In an exemplary embodiment, the mounting structure engages the fasteners of flange 106, thereby avoiding requiring additional fasteners or mounting apparatus. More particularly, the fasteners may include threaded shafts (e.g., the shafts of threaded bolts 108), and the mounting structure of mounting plate 116 of securing apparatus 112 includes at least one orifice 122 (FIG. 2) dimensioned and configured to pass the threaded shafts of the fasteners therethrough. Providing orifices 122 enables the fasteners including nuts 110 (FIG. 3) being used to secure closure 104 in place, thereby avoiding the requirement for additional hardware or apparatus in this exemplary embodiment. In the exemplary embodiment, the at least one orifice 122 includes at least one elongated-shaped hole 122 as shown. This embodiment accommodates minor misalignments which may occur when positioning securing apparatus 112 relative to flange 106.

In the illustrated exemplary embodiment, mounting plate 116 includes a recess 124 projecting in a concave fashion into mounting plate 116. Here, recess 124 is dimensioned and configured to avoid causing mounting plate 116 to obstruct portal 114 when securing apparatus 112 is installed onto manway 102. The features of this embodiment are also illustrated in FIG. 3 (described below).

In certain vessels 100 which are temporarily modified in accordance with the embodiments to accommodate mounting of securing apparatus 112, portal 114 is of a circular shape. Here, recess 124 is arcuate and reflects the configuration of portal 114 of manway 102. In additional embodiments, however, where portal 114 is of another shape (e.g., rectangular), recess 124 is fashioned to snugly fit with respect to such other shapes.

Figure 3:
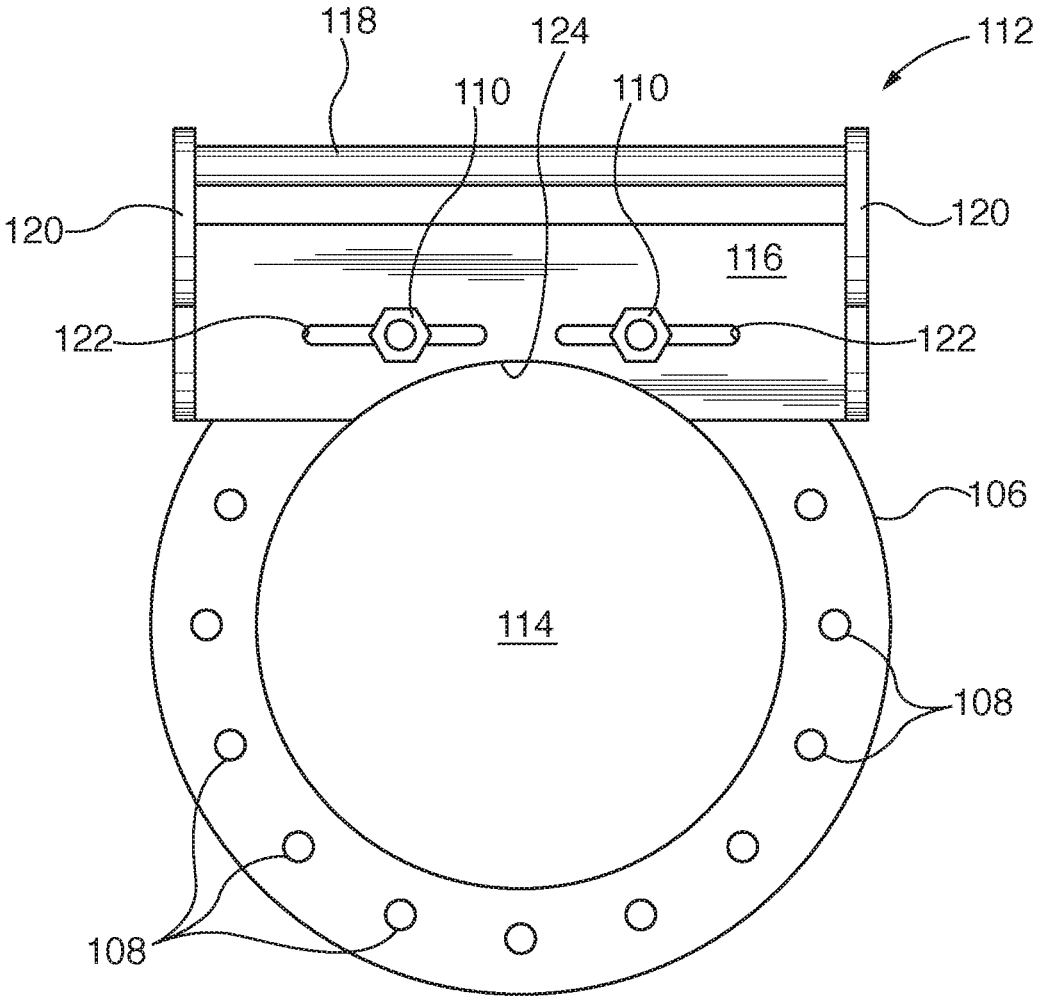
FIG. 3 is a top plan view of the vessel of FIG. 1 with the inventive securing apparatus shown in FIG. 2 installed thereon, according to certain embodiments.

Referring particularly to FIG. 3, in securing apparatus 112, the handle (e.g., grab bar 118) is offset from recess 124 so that the handle avoids obstructing portal 114 when securing apparatus 112 is installed on manway 102. In the exemplary embodiments of FIGS. 2 and 3, the handle is located away from portal 114 relative to mounting plate 116 to provide ergonomic accommodation of an arm of the service personnel entering vessel 100.

With continued reference to FIGS. 1-3, and in accordance with certain exemplary embodiments, vessel 100 includes one or more manways 102 of one or more shapes, for enabling entry by service personnel. Vessel 100 includes associated securing apparatus 112 enabling entry of service personnel into vessel 100. Vessel 100 includes an outer wall 126 defining a chamber 128 for enclosing contents of vessel 100. Manway 102 penetrates outer wall 126 and enables entry of a person into chamber 128. Manway 102 includes portal 114 to chamber 128, closure 104, and elongated fasteners (e.g., bolts 108) for securing closure 104 over portal 114. Removable securing apparatus 112 includes mounting structure (e.g., mounting plate 116 and holes 122) cooperating with the fasteners, whereby removable securing apparatus 112 may be installed on manway 102 after closure 104 has been removed from manway 102.

In vessel 100, the fasteners each include a shaft, and removable securing apparatus 112 includes holes 122 dimensioned and configured to pass the shafts of the fasteners therethrough. Manway 102 includes flange 106 encircling portal 114 and presenting a flat face 130 facing away from chamber 128. The fasteners engage flange 106 when securing closure 104 over portal 114. Securing apparatus 112 includes mounting plate 116 including a surface 132 (FIG. 2) seating flush against flat face 130 of flange 106 when mounting plate 116 is installed on manway 102. The fasteners are reassembled to flange 106 to mount mounting plate 116 to manway 102 when closure 104 has been removed to enable entry of service personnel into vessel 100. In an exemplary embodiment, a soft material (e.g., rubber) is placed between surface 132 and flat face 130 to prevent damage to the gasket sealing surface of the flange 106.

In vessel 100, portal 114 is circular, and mounting plate 116 includes recess 124 projecting into mounting plate 116, whereby portal 114 of manway 102 remains unobstructed by mounting plate 116 when securing apparatus 112 is installed on manway 102.

Using the apparatus described herein, a method of facilitating entry of service personnel into vessel 100 through manway 102 of vessel 100 includes removing a closure 104 from manway 102 by removing fasteners coupling closure 104 to manway 102; installing securing apparatus 112 in place of closure 104, where securing apparatus 112 has a mounting structure cooperating with the fasteners of closure 104; and fastening the securing apparatus 112 to manway 102 in place of closure 104, using the fasteners coupling closure 104 to manway 102. The method of facilitating entry may further include stabilizing securing apparatus 112 on manway 102 by seating a surface (e.g., surface 132) of mounting plate 116 of securing apparatus 112 flush against flange 106 of manway 102 when the fasteners secure mounting plate 116 of securing apparatus 112 to flange 106 of manway 102.

In various embodiments, differing materials (e.g., wood and/or steel) are used to manufacture securing apparatus 112. In an exemplary such steel embodiment, securing apparatus 112 is cut out of ⅜ inch thick carbon steel plate; the frame is bent with a hydraulic bender on both ends to create the stanchions 120; a 1 inch round bar made of carbon steel is inserted through the round holes in the frame of the stanchions; the bar is welded, on the inside and/or outside at both ends to the stanchions. In the various embodiments, the size of securing apparatus 112 depends on the size of the manway 102. For example, in an exemplary embodiment wherein flange 106 is 18 inches, a completed securing apparatus 112 of dimensions 24 inches width, 9 inches height, 6 inches depth can be used.

It will be appreciated that although manway 102 has been depicted herein as opening vertically, above vessel 100, other orientations of manway 102 are possible. For example, manway 102 may open vertically downwardly, horizontally at a side of vessel 100, or alternatively, at any angle to a vertical direction.

In the preceding description, numerous specific details are set forth in order to provide an understanding of the present invention. It will be apparent, however, to one skilled in the art that the present invention may be practiced without these specific details. The specific details may be varied from and still be contemplated to be within the spirit and scope of the present disclosure. Many modifications of examples set forth herein will come to mind to one skilled in the art to which the present disclosure pertains having the benefit of the teachings presented in the foregoing descriptions and the associated drawings.

This written description uses examples of the subject matter disclosed to enable any person skilled in the art to practice the same, including making and using any devices or systems and performing any incorporated methods. The patentable scope of the subject matter is defined by the claims, and can include other examples that occur to those skilled in the art. Such other examples are intended to be within the scope of the claims.

The above-described embodiments are intended to be illustrative in all respects, rather than restrictive, of the embodiments. Thus, the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items. Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

I claim:

1. A securing apparatus for temporary mounting to a flange of a manway comprising a portal and facilitating entry therein by service personnel into a vessel and wherein said portal defines a tubular path perpendicular to said portal, the securing apparatus comprising a mounting plate, said plate comprising a planar shape and having a lower surface adapted for temporarily mounting to a top surface of said flange and adjacent to said manway in a fixed position, said plate further comprising a lateral side having an arcuate shaped recess portion, and a handle for accommodating manual grasp of the securing apparatus by said service personnel, wherein said handle is attached to said mounting plate with a pair of stanchions that extend perpendicular from said plate and support and are attached to opposite sides of said handle above said plate and said handle further comprises a linear rod section, said rod section is vertically displaced from said mounting plate, whereby the portal of the manway remains unobstructed by said handle when the securing apparatus is in a state of engagement on the manway and wherein said linear rod section of said handle has a length of approximately 24 inches.

2. The securing apparatus of claim 1, wherein the flange of the manway is secured to a closure over the manway by one or more fasteners, and the mounting plate of the securing apparatus comprises a mounting structure cooperating with the fasteners.

3. The securing apparatus of claim 2, wherein the fasteners define threaded shafts thereon, and the mounting structure defines at least one orifice dimensioned and configured to pass said threaded shafts therethrough.

4. The securing apparatus of claim 3, wherein the at least one orifice comprises at least one elongated hole, and said elongated hole comprises a slot.

5. The securing apparatus of claim 1, wherein the mounting plate defines a recess projecting therein, the recess being dimensioned and configured to prevent the mounting plate from obstructing said portal when the securing apparatus is installed on to the manway.

6. The securing apparatus of claim 5, wherein a cross-section of the portal is circular in shape, and the recess is arcuate in shape and said conforms to a configuration of the portal of the manway.

7. The securing apparatus of claim 5, wherein the handle is offset from the center of said plate wherein when installed on a manway the handle avoids obstructing the portal when the securing apparatus is installed on the manway.

8. The securing apparatus of claim 1, wherein the handle comprises a grab bar respectively coupled to and spaced apart from the mounting plate, and said bar is parallel to a tangent to circle defined by said portal.

9. The securing apparatus of claim 8, further comprising two stanchions for supporting the grab bar, the grab bar being positioned between the two stanchions.

10. The securing apparatus of claim 9, wherein the grab bar is circular in cross-section thereof and the positioning thereof comprises being affixed along a longitudinal axis between the two stanchions.

11. A vessel comprising a manway for enabling entry therein, the vessel comprising:

an outer wall defining a chamber for enclosing contents of the vessel;

the manway defining a circular portal to the chamber, the portal penetrating said outer wall and further comprising an flange portion, said portal oriented so that the opening is in a horizontal plane, the manway comprising a closure and one or more elongated fasteners operable to secure the closure over the portal; and a removable securing apparatus including a flat mounting plate cooperating with said fasteners, the removable securing apparatus being operable for installation thereof on the manway wherein the closure is disengaged from the manway, and the securing apparatus further comprising a handle affixed to said flat mounting plate wherein said handle is attached to opposite stanchions that extend from a top surface of said flat mounting plate and comprises a linear rod section, said rod section is elevated and offset from the center of said flat mounting plate and said flat mounting plate having an arcuate lateral side form a recess.

12. The vessel of claim 11, wherein at least one said fastener comprises a shaft portion, and the removable securing apparatus defines at least one orifice being dimensioned and configured for passage therethrough of said shaft portion.

13. The vessel of claim 11, wherein:

said flange portion further comprises an annular ring encircling the portal and presenting a flat top front face facing away from the chamber;

the fasteners being operable to engage the flange portion when serving to secure the closure over the portal; and said mounting plate comprising a surface thereof operable to seat flush against the flat top front face of said flange when the mounting plate is engaged with the manway, and the fasteners are operable to be reassembled to the flange to mount the mounting plate to the manway when the closure has been disengaged from the manway.

14. The vessel of claim 13, wherein the portal is circular in cross-section, and said mounting plate defines a recess portion thereof projecting into the mounting plate and said recess portion has a profile that is the same as the outer edge of the portal, whereby the portal of the manway remains unobstructed by the mounting plate when the securing apparatus is in a state of engagement on the manway.

15. The device as recited in claim 1 wherein said rod section comprises a straight section that extends a distance of approximately 24 inches.

16. The device as recited in claim 11 wherein said rod section comprises a straight section that extends a distance of approximately 24 inches.

* * * * *